United States Patent [19]

Cooke et al.

[11] 4,428,608

[45] Jan. 31, 1984

[54] TOGGLE FASTENERS

[76] Inventors: Robert S. Cooke; Howard R. S. Cooke, both of 366 Station Rd., Dorridge, Solihull, West Midlands, England

[21] Appl. No.: 289,316

[22] Filed: Aug. 3, 1981

[30] Foreign Application Priority Data

Aug. 26, 1980 [GB] United Kingdom ..... 8027625

[51] Int. Cl.[3] ..... E05C 5/00; E05C 19/14

[52] U.S. Cl. ..... 292/247; 70/76; 292/7; 292/177

[58] Field of Search ..... 292/247, 177, 113, 66, 292/DIG. 49, DIG. 73, 7; 70/76, 73

[56] References Cited

U.S. PATENT DOCUMENTS 1,722,562 7/1929 Davis ..... 292/113
1,784,475 12/1930 Young ..... 292/113 X

FOREIGN PATENT DOCUMENTS 265711 4/1913 Fed. Rep. of Germany ..... 292/247
286717 3/1953 Switzerland ..... 292/247
1230224 4/1971 United Kingdom ..... 292/247

*Primary Examiner*—Thomas J. Holko
*Assistant Examiner*—R. Illich
*Attorney, Agent, or Firm*—C. O. Marshall, Jr.

[57] ABSTRACT

A toggle fastener comprises first and second parts in which the first is a keeper having a cavity. The second part has a bolt slidable therein having a nose adapted to be received in said cavity, and also having hinged thereto a lever on which is pivoted a hasp. The nose of the bolt is adapted to protrude through an opening in the keeper. A cam surface on the nose of the bolt is inclined to the axis of the bolt, and a cam surface on the keeper adjacent to said opening and is opposed to and is inclined oppositely to the cam surface on the nose of the bolt. Said hasp is engageable with both of said cam surfaces in order to cam the keeper and the bolt in opposite directions to prevent rattling.

3 Claims, 6 Drawing Figures

TOGGLE FASTENERS

DESCRIPTION

A toggle fastener comprises first and second parts for fixing to two separable articles or components, one of which parts may be called a keeper, and the other of which includes a hasp for engagement with that keeper. The hasp is pivotally mounted on a lever, generally midway between the ends of the lever, and one end of the lever is pivoted to said other part. By pivoting the lever so that the hasp lever and attachment part lie generally in the fashion of a Z, and then engaging the free end of the hasp with the keeper before returning the hasp, lever and attachment part to generally parallel positions, the keeper will be drawn towards said second part and the separate articles or components will be latched together. Often, the final part of the required movement involves an over-centre action which provides a degree of security of fastening.

Many different designs of toggle fasteners are known, possessing particular advantages in particular circumstances, but there is one general situation where two separable articles or components are to be fixed together where the ordinary toggle fastener is unsatisfactory. This is the situation where the two components or articles are capable of relative movement in one or more directions transverse to the pivotal axis of the hasp, and normal to the length of the complete fastener. If an ordinary toggle fastener is used in such circumstances, the movement of the part swings the hasp about its pivotal axis and can displace the fastener to the release position.

In Swiss Pat. No. 286717, a modified toggle fastener is proposed, in which the lever is pivoted on a bolt 13, and a spring 8 is provided to withdraw that bolt from the keeper. When the lever is swung to the closed position, the bolt is forced into the keeper and is drawn towards the end (22) of the hasp loop (21 23). It certainly provides an additional degree of security, but it is necessary to provide a working clearance between the bolt (13) and the interior of the keeper which receives the bolt, and that clearance inevitably enables relative movement of the parts and hence allows the parts to rattle if subject to vibration.

German Pat. No. 265711 shows a generally similar construction, except that here the bolt is cylindrical instead of being flat, but again it is necessary to provide a cylindrical hole in the keeper and inevitably a clearance is necessary so that rattle is possible.

The object of the present invention is to provide an improved fastener of this kind which is not subject to rattle.

In accordance with the invention a toggle fastener comprises first and second parts in which the first is the keeper and has a cavity to receive the nose of a bolt slidable on the second part, the said second part also comprising the lever which is hinged to the bolt and pivotally mounts the hasp, and when the hasp is engaged with the keeper, the hasp abuts the nose of the bolt.

Preferably the bolt is spring urged in a direction which will disengage it from the keeper. The bolt nose may have a substantial clearance about its periphery between it and the keeper cavity.

One presently preferred embodiment of the invention will now be more particularly described with reference to the accompanying drawings wherein.

Figure 1:
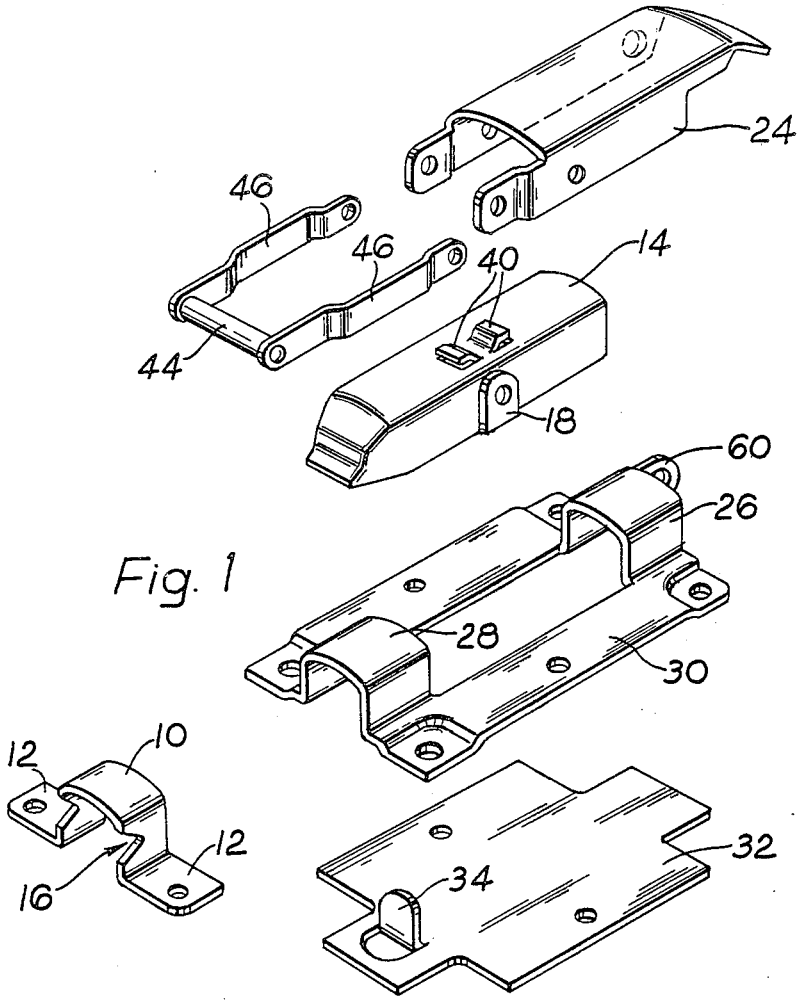
FIG. 1 is an exploded perspective view.

Turning now to the drawings and particularly FIG. 1 thereof, these show a fastener made (in this instance) as a number of sheet metal pressings, and comprising a keeper 10 which has a pair of co-planar attachment flanges 12 by means of which it may be fixed to a first article or component, the keeper having an internal cross section which is generally similar to the external cross section of the nose of a bolt, the bolt being generally indicated by the reference numeral 14. The edge of the keeper which is most remote from the bolt is recessed at 16 and the purpose of the recesses will be understood after consideration of the following and more detailed description.

Figure 2:
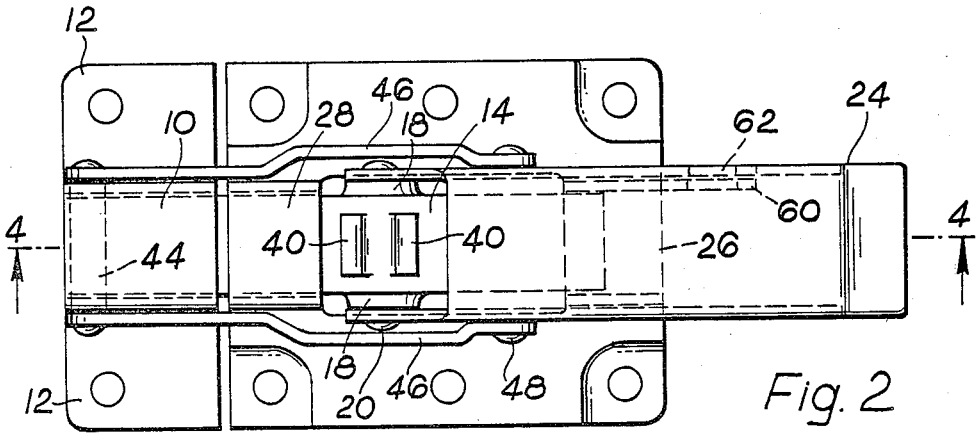
FIG. 2 is a plan view of the assembled and complete fastener in the closed position.

The bolt is a hollow box-like part provided with bosses 18 on each face and these are coaxially apertured to receive rivets 20 (FIG. 2) by means of which a lever 24 is pivoted to the bolt. The bolt is slidable in guides 26 28 forming part of a body pressing generally indicated by the reference numeral 30 and which is fixed to a base plate 32. A tongue 34 is struck up out of the base plate and projecting to the interior of the bolt so as to form an end abutment for a coil spring 36 (FIG. 4) the opposite end of the spring abutting an end face 38 (FIG. 4) of the bolt.

The bolt has a pair of projections 40 raised out of its top face and these act as abutments limiting travel of the bolt by contact with the guides 26 28 according to the direction of movement. Particular attention is directed towards the shape of the nose of the bolt as seen in side elevation or cross section, see for example FIG. 4 including the inclined face 42, as there seen contacted by cross pin 44 which is carried between a pair of arms 46 pivoted to the lever 24 by appropriate rivets 48 (FIG. 3) midway along the length of the lever. The parts 44 and 46 together form the hasp.

Figure 4:
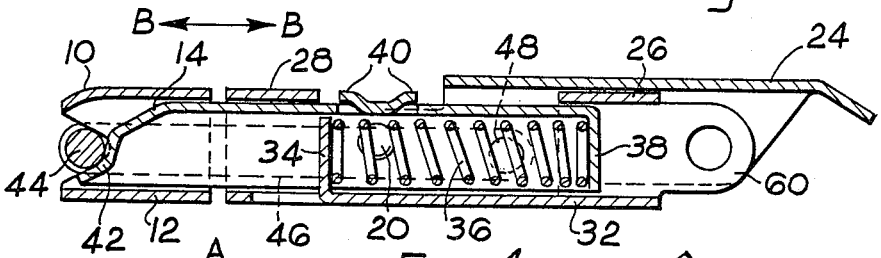
FIG. 4 is a section taken on the line 4—4 of FIG. 2.
Figure 5:
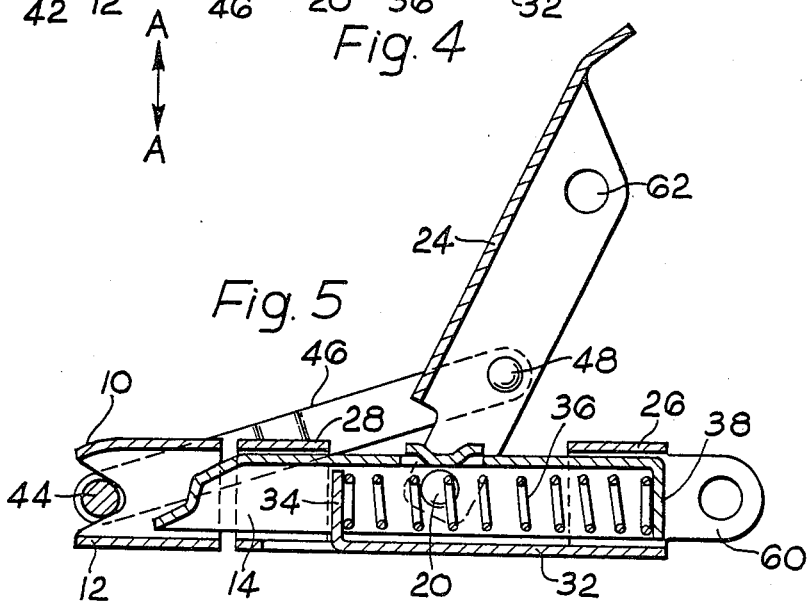
FIG. 5 shows the parts in a partially released condition and FIG. 6 shows the parts in a completely released condition.
Figure 6:
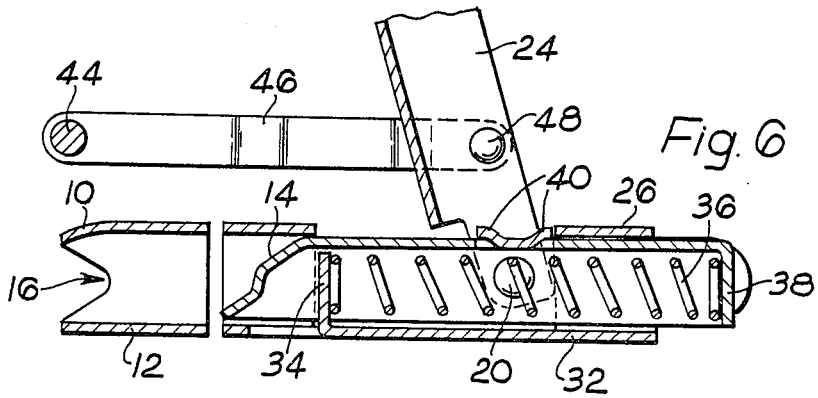

Reference to the drawings and in particular FIGS. 4, 5 and 6 will show that the pin 44 contacts the inclined face 42 when the fastener is in the closed position, and the bolt is centred and wedged firmly in the keeper despite the substantial clearance between the nose of the bolt and the keeper. Because the wedging action is due to the hasp part 44 which is moved in the opposite direction to that of the bolt in the releasing operation, the wedging does not make release difficult. FIG. 4 actually shows a clearance beneath the bolt, i.e. between it and the keeper, but thus illustration is for clarity of understanding, and in fact the hasp will hold the bolt firmly against the base plate 12 with a cam-like action. The recesses 16 in the keeper are necessarily shaped to allow the inter-engagement of hasp and keeper for these purposes. It will be noted that the bolt prevents relative movement, e.g. of the keeper and base plate 32 in the direction of the arrows A FIG. 4 as well as preventing relative movement of the two parts in the direction of the arrows B in the same figure. When the lever 24 is lifted, with slight over centre movement (note that the rivets 48 are slightly closer to the base plate than the rivets 20) the hasp is released from the keeper and from the bolt, and the bolt is then spring driven to the FIG. 6 position. In the reverse situation, when securing a fastener, the parts are arranged in the FIG. 6 position and the hasp is then manually engaged with the keeper and the lever is swung back through the FIG. 5 position to the FIG. 4 position thus returning all of the parts to the FIG. 4 position, shooting the bolt, and fixing it in place by the hasp.

Figure 3:
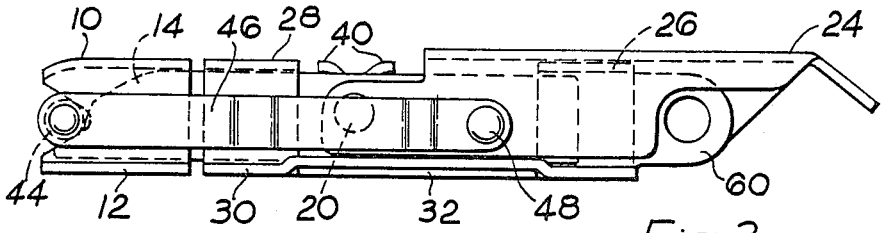
FIG. 3 is a side elevation corresponding to FIG. 2.

Various additional safety or security measures may be provided, and for example the part 30 may be provided with a projecting lug 60 having an aperture which can be aligned with the aperture 62 in the lever when the parts are in the FIGS. 3 and 4 position. A padlock or springloaded detent can be engaged through those holes. Additionally or alternatively, the lever may carry a catch which can be manually displaced in the direction of the arrow B so as to hook engage with the base plate and thus prevent inadvertent movement of the lever towards the FIG. 5 position.

The lug 34 may be modified so that it enters into the adjacent end of the spring 36 so as to locate it more securely.

We claim:

1. A toggle fastener comprising first and second parts in which the first is a keeper having a cavity, and the second part has a bolt slidable therein having a nose adapted to be received in said cavity, and also having hinged thereto a lever on which is pivoted a hasp, wherein the improvement comprises (a) an opening in the keeper through which the nose of the bolt is adapted to protrude, (b) a cam surface on the nose of the bolt which is inclined to the axis of the bolt and (c) a cam surface on the keeper which is adjacent to said opening and which is opposed to and is inclined oppositely to the cam surface on the nose of the bolt, (d) said hasp being engageable with both of said cam surfaces in order to cam the keeper and the bolt in opposite directions to prevent rattling.

2. A toggle fastener as claimed in claim 1 wherein the bolt (14) nose has a clearance about its periphery between it and the keeper cavity.

3. A toggle fastener as claimed in claim 1 wherein the bolt is a hollow box-like part and a compression spring (36) for retracting the bolt is located in and along the bolt, being trapped between an end wall (38) of the bolt and a lug (34) upstanding from the base of a stationary casing (26,32) in which the bolt slides, said lug projecting into the bolt.

* * * * *